US009604748B2

(12) United States Patent
Frank

(10) Patent No.: US 9,604,748 B2
(45) Date of Patent: Mar. 28, 2017

(54) DEVICE FOR SHAPING A FLAT BLANK INTO A CONTAINER

(75) Inventor: Alexander Frank, Schaffhausen (CH)

(73) Assignee: Robert Bosch GmbH, Stuttgart (DE)

( * ) Notice: Subject to any disclaimer, the term of this patent is extended or adjusted under 35 U.S.C. 154(b) by 728 days.

(21) Appl. No.: 13/984,891

(22) PCT Filed: Jan. 31, 2012

(86) PCT No.: PCT/EP2012/051501

§ 371 (c)(1),
(2), (4) Date: Aug. 12, 2013

(87) PCT Pub. No.: WO2012/107317

PCT Pub. Date: Aug. 16, 2012

(65) Prior Publication Data

US 2013/0324385 A1 Dec. 5, 2013

(30) Foreign Application Priority Data

Feb. 11, 2011 (DE) ..... 10 2011 004 004

(51) Int. Cl.
*B65D 1/22* (2006.01)
*B31B 1/00* (2006.01)

(52) U.S. Cl.
CPC ..... *B65D 1/22* (2013.01); *B31B 1/00* (2013.01); *B31B 2201/2654* (2013.01); *B31B 2203/066* (2013.01)

(58) Field of Classification Search
CPC ..... B31B 1/00; B31B 1/44; B31B 2203/00; B65D 1/22
See application file for complete search history.

(56) References Cited

U.S. PATENT DOCUMENTS 62,952 A 3/1867 Foster
2,832,270 A * 4/1958 Pierce, Jr. ..... B31B 1/46 493/114

(Continued)

FOREIGN PATENT DOCUMENTS

CN 2330502 7/1999
CN 1853916 11/2006

(Continued)

OTHER PUBLICATIONS

International Search Report for Application No. PCT/EP2012/051501 dated May 23, 2012 (2 pages).

*Primary Examiner* — Michelle Lopez
*Assistant Examiner* — Chinyere Rushing-Tucker
(74) *Attorney, Agent, or Firm* — Michael Best & Friedrich LLP

(57) ABSTRACT

In a device for shaping a flat blank (46) made of cardboard into a container (48), comprising a shaping tool (50) and a ram (10) which can be moved in a primary shaping direction (z) into the shaping tool (50) so as to erect the flat blank by means of the shaping tool (50), at least two lateral walls (18) which can be pivoted about a respective pivot axis (s) located transversely relative to the primary shaping direction (z) are hinged to the ram (10), whereby a main surface defined by the free end edges (19) of the lateral walls (18) can be adjusted. In order to carry out a pivoting motion, the lateral walls (18) are seated in a non-positively sliding manner against wedge elements (28) by means of pretensioned spring elements (22, 24), the wedge elements being displaceable in the primary shaping direction (z).

14 Claims, 13 Drawing Sheets

(56) References Cited

U.S. PATENT DOCUMENTS

| | | | | | |
|---|---|---|---|---|---|
| 2,930,294 | A | | 3/1960 | Arthur | |
| 3,376,797 | A | * | 4/1968 | Scace | B31B 1/50 493/139 |
| 3,800,681 | A | | 4/1974 | Corderoy | |
| 4,341,055 | A | * | 7/1982 | Williams | B31B 1/44 493/168 |
| 4,345,905 | A | * | 8/1982 | Moen | B31B 1/46 493/131 |
| 4,493,682 | A | * | 1/1985 | Bryson | B31B 1/46 493/137 |
| 4,897,031 | A | * | 1/1990 | Weder | B31B 1/90 493/338 |
| 4,988,331 | A | | 1/1991 | Boisseau | |
| 5,024,641 | A | * | 6/1991 | Boisseau | B31B 1/44 493/143 |
| 5,356,071 | A | * | 10/1994 | Schmissrauter | B31B 1/44 229/160 |

FOREIGN PATENT DOCUMENTS

| | | |
|---|---|---|
| DE | 20019140 | 3/2001 |
| ES | 2177470 | 12/2002 |

* cited by examiner

DEVICE FOR SHAPING A FLAT BLANK INTO A CONTAINER

BACKGROUND OF THE INVENTION

Technical Field

Devices for shaping a cardboard flat blank into a container, comprising a shaping tool and a ram which is movable in a principal shaping direction into the shaping tool so as to erect the flat blank via the shaping tool, wherein the extent of the ram is adjustable in at least one shape-shaping direction lying transversely to the principal shaping direction, are already known.

These devices serve to shape and fold cardboard flat blanks into containers, as are often used for the packaging of a plurality of individual products, inter alia in the food, pharmaceuticals and healthcare industries.

The cardboard flat blanks are fed to a shaping and folding apparatus and forced through a shaping tool by means of a ram, whereupon they are shaped into a cardboard container. The shaped cartons are then fed to a packaging plant, filled and closed again. These process steps can be performed by means of a plurality of machines, but also with a single machine which has integrated all these functions.

SUMMARY OF THE INVENTION

The invention relates to a device for shaping a cardboard flat blank into a container, comprising a shaping tool and a ram which is movable in a principal shaping direction into the shaping tool so as to erect the flat blank via the shaping tool, wherein a base area of the ram is adjustable in at least one shape-shaping direction lying transversely to the principal shaping direction.

It is proposed that at least two side walls pivotable about, respectively, a pivot axis lying transversely to the principal shaping direction are articulately attached to the ram, whereby a base area delimited by the free end edges of the side walls is adjustable, the side walls bearing in a frictionally sliding manner by means of pretensioned spring elements, for the execution of a pivot motion, against wedge elements which are displaceable in the principal shaping direction.

By a "principal shaping direction" should be understood, in particular, the direction in which the cardboard blank is forced through the shaping tool by means of the ram and is hereupon shaped. It can stand obliquely to the perpendicular at an angle of 10° to 90°, for example at an angle of 30°. A perpendicular principal shaping direction is preferred.

Preferably, the base area delimited by the end edges has the shape of a polygon. In particular, the number of side walls can determine the number of corners of the polygon.

Particularly preferably, side walls which face one another in pairs are disposed on the ram. In particular, the base area delimited by the end edges of the side walls can have the shape of a rectangle.

The side walls are preferably arranged parallel to the principal shaping direction. Alternatively, they can also be arranged obliquely. Containers can thus also be shaped with oblique side walls.

Preferably, the base area is oriented perpendicularly to the principal shaping direction. The base area can also, however, be oriented obliquely to the principal shaping direction.

Preferably, the ram has a lower base plate and the wedge elements are disposed between the lower base plate and the side walls, wherein the wedge elements bear against the lower base plate and the side walls.

Preferably, each pivotable side wall is pulled by a plurality of spring elements towards the lower base plate. Particularly preferably, each pivotable side part is pulled with two spring elements in the direction of the lower base plate, wherein advantageously one spring element is fastened in the upper, the other in the lower third of the side wall. Particularly advantageously, each pivotable side part can be pulled with a spring element which is preferably fastened in the upper third of the side wall. The spring elements can be fastened to the side wall by means of a pin or the like. Preferably, the spring elements can be fastened to a mounting or flap which is shaped out of the side part.

Alternatively, the spring elements can be fastened between two adjacent side walls. As a result of the angled-off arrangement of the side walls, these can be pulled in the direction of the bottom part.

The wedge elements can be configured as corner pieces with sloping faces and bear slidingly against corner cutouts of the lower base plate. Preferably, the sloping faces can merge on the side of the free end of the ram into an end face running parallel to the principal shaping direction. The wedge elements and the lower base plate can thereby touch squarely, whereby an optimal force transfer can be ensured.

Preferably, the wedge elements are produced from a plastic. Particularly preferably, the bottom part can be coated with a plastics layer. Alternatively, between the bottom part and the wedge element, a plastics part can be placed onto the bottom part. The sliding behavior of the wedge can thereby be improved in relation to the bottom part, so that the wear to both the wedge and the bottom part can advantageously be reduced.

The wedge elements are preferably displaceable by means of pneumatic cylinders.

Advantageously, the wedge elements can be displaced over the end edges of the side walls. If the wedge elements are displaced downwards in order that the side walls are pivoted, the shaped container can additionally be actively pushed by the ram. The risk of the shaped container remaining stuck to the ram can thereby advantageously be reduced, so that breakdowns can be prevented.

The side walls are expediently articulately attached to an upper base plate. They can preferably be fastened with one or more screws to the upper base plate. Particularly preferably, the side walls can be mounted on the upper base plate by means of plastics cams.

The ram has on its free end preferably at least one suction element. By means of the suction force, the shaped container can be pulled onto the ram. It can thereby be possible to pull the shaped container back through the shaping tool.

Particularly advantageously, the inventive device comprises a multiplicity of rams with associated shaping tools for simultaneously shaping a plurality of cardboard flat blanks into containers. The controlling of the pivot motion of the side walls can be realized jointly. Advantageously, the pivot motion for each ram can be controlled individually for each ram. Alternatively, two rams can be controlled in pairs. If there is no cardboard blank present in respect of one of these rams, the shaping operation can be performed for all the rams. The pivot motion of the side walls of the ram with missing cardboard blank can here be presumed. Unnecessary wear to the corresponding ram and to the associated shaping tool can hence be avoided, thereby increasing the service life. Likewise, the fault tolerance of the plant can be increased.

With the invention, the following advantages can be obtained:

The carton, after having been shaped, is less able to remain stuck to the ram; greater production reliability with fewer breakdowns can hence be obtained. In the event of breakdowns, the plant would have to be stopped, the safety boarding opened and the jammed carton removed. After this, the plant is restarted. In configurations in which the carton is deposited in a carton supply chain, this breakdown can mean a missed cut, which, in addition to the actual stoppage of the machine, impacts negatively on the efficiency of the machine.

The wedge has two functions: diminution of the outline of the ram and active expulsion of the shaped carton from the ram.

Through the use of suckers, the shaped carton can be pulled back again through the tool. Thus a very flexible arrangement of cardboard blank supply, tool and evacuation is possible.

If, in multilane machines, no cardboard blank is ready in a lane, the "empty" ram can remain tapered and thus does not graze the tool in case of intrusion without cardboard blank; less wear is thereby obtained.

Through the use of sheets, a simpler construction can be achieved. The format-dependent parts are all produced from a sheet blank, that is to say only one production drawing is needed for this purpose, whereby the process is substantially simplified.

The side walls can hence be inserted and do not have to be screwed together, which is likewise cheaper in terms of production.

BRIEF DESCRIPTION OF THE DRAWING

Further advantages, features and details of the invention emerge from the following description of preferred illustrative embodiments and with the aid of the drawing, which serves merely for illustration and should not be interpreted restrictively. The drawing shows schematically in.

DETAILED DESCRIPTION

Figure 1:
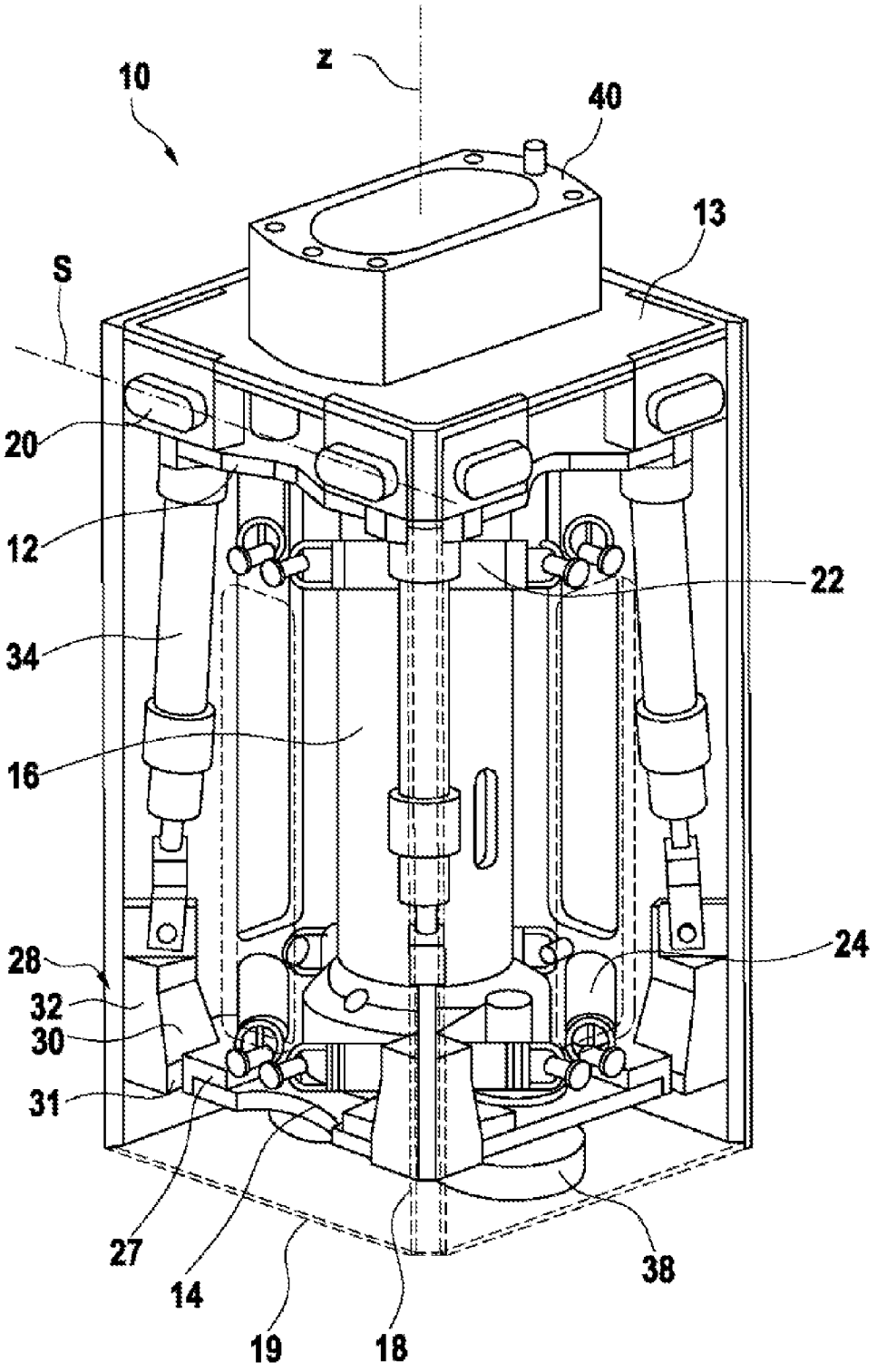
FIG. 1 a perspective view of a ram for shaping a cardboard flat blank.

A ram 10 represented in FIG. 1, for shaping a cardboard flat blank into a container, substantially consists of a main body having an upper base plate 12 covered by a cover plate 13 and connected to this latter, a lower base plate 14, and a central middle part 16 which connects the two base plates 12, 14 of substantially rectangular outline and which is disposed in a principal shaping direction z. To each of the four sides of the upper base plate 12 is articulately attached a side wall 18, which projects beyond the lower base plate 14.

The side walls 18 are mounted on plastics cams 20 fastened in the region of the upper base plate 12 and the above-situated cover plate 13 and, by virtue of the elasticity of the plastics material, are pivotable about the pivot axis s formed by the plastics cams 20. Alternatively, the pivotability can be given by a play between the plastics cams 20 and correspondingly sized holes in the side walls 18. Adjacent side walls 18 are connected in the region of the base plates 12, 14 by tensioned upper and lower spring elements 22, 24.

The lower base plate 14 has at its corners rectangular corner cutouts 26, in which corner pieces 28, which are displaceable in the principal shaping direction z, engage. The corner pieces 28 have two sloping faces 30, which bear slidingly against the two sides of the corner cutouts 26 in the lower base plate 14. The sloping faces 30 of adjacent corner pieces 28 converge in the direction of the free end of the ram 10 and merge into an end face 31 parallel to the principal shaping direction z. The dimensioning of the end face in the principal shaping direction z roughly corresponds to the thickness of the lower base plate 14. Those faces of the corner pieces 28 which do not engage in the corner cutouts 26 and which run in the principal shaping direction z form bearing surfaces 32 for the side walls 18.

Figure 4:
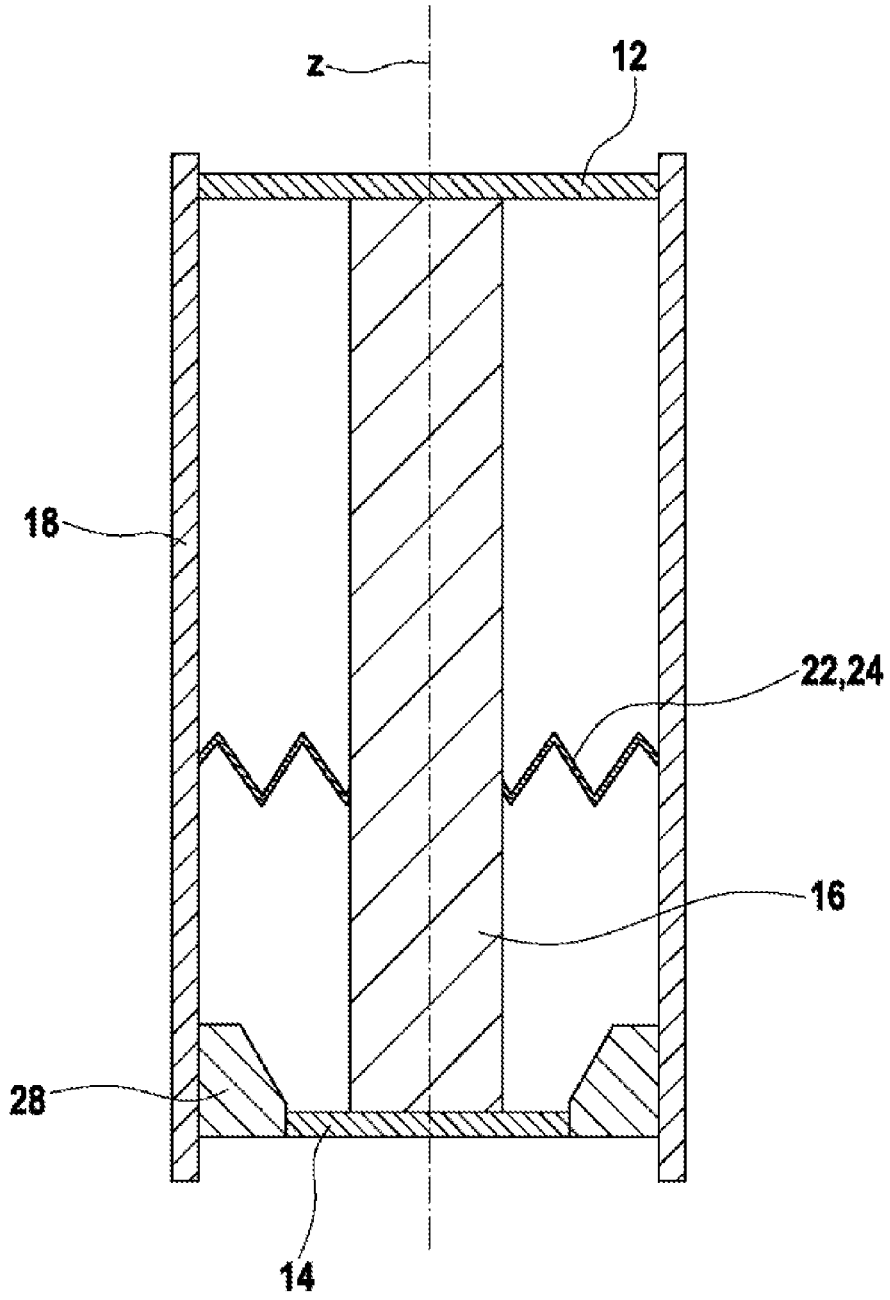
FIG. 4 a longitudinal section through a ram presenting a first position of the side walls.
Figure 5:
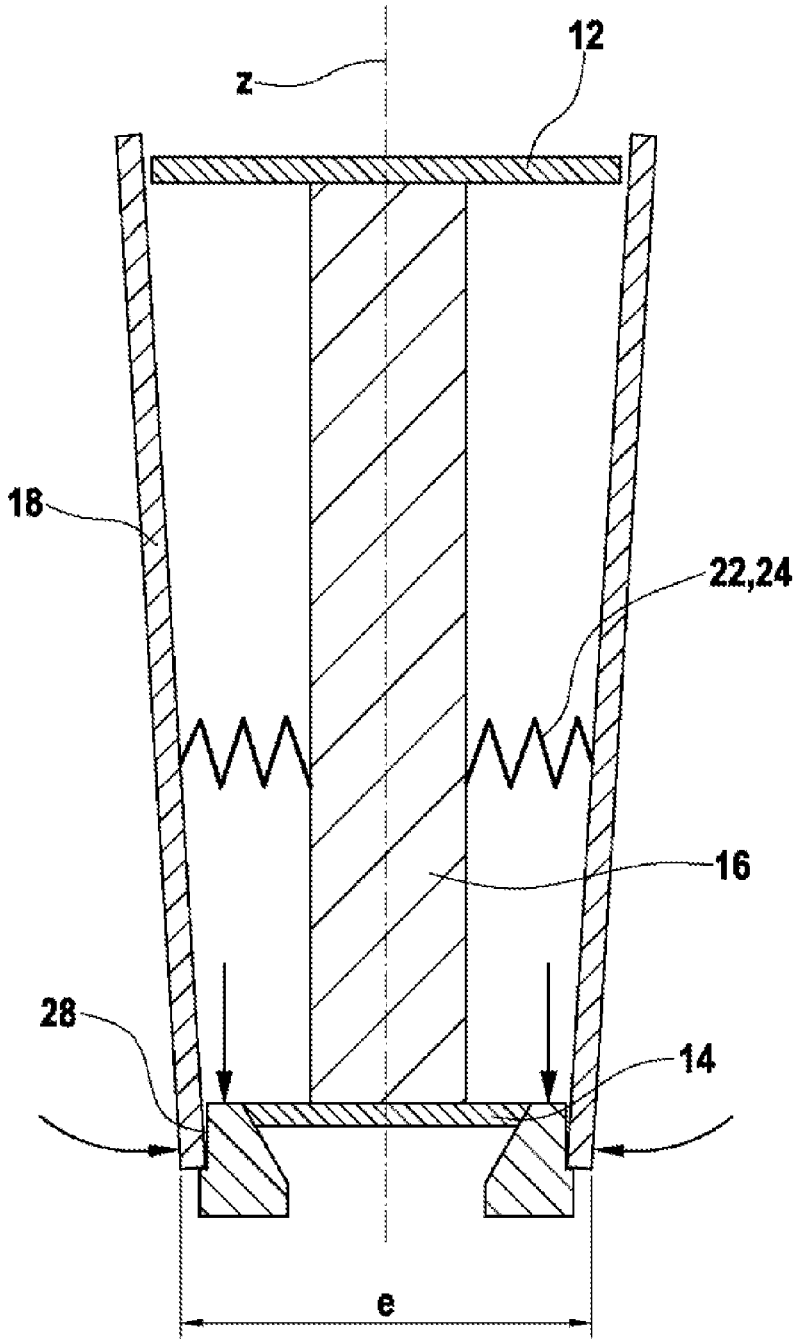
FIG. 5 the longitudinal section of FIG. 4 through a ram presenting a second position of the side walls.
Figure 6:
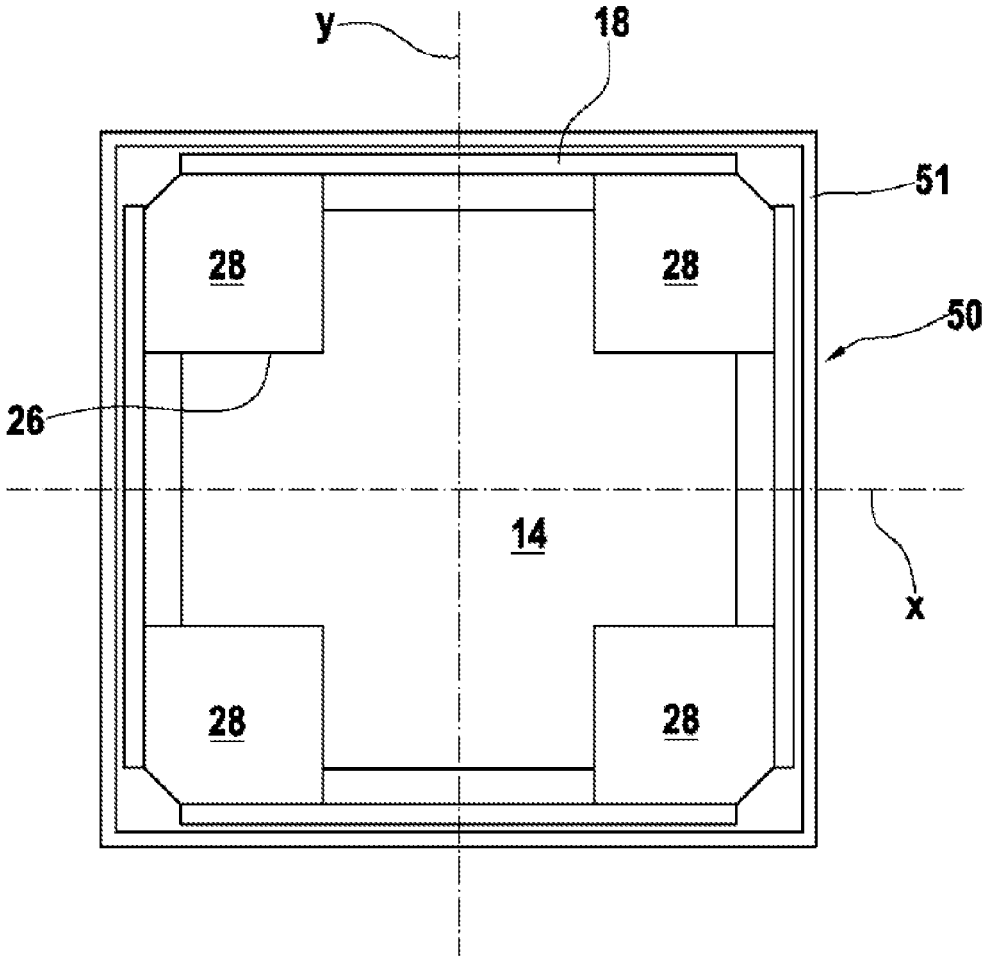
FIG. 6 a view from below of a ram in a first shaping tool.
Figure 7:
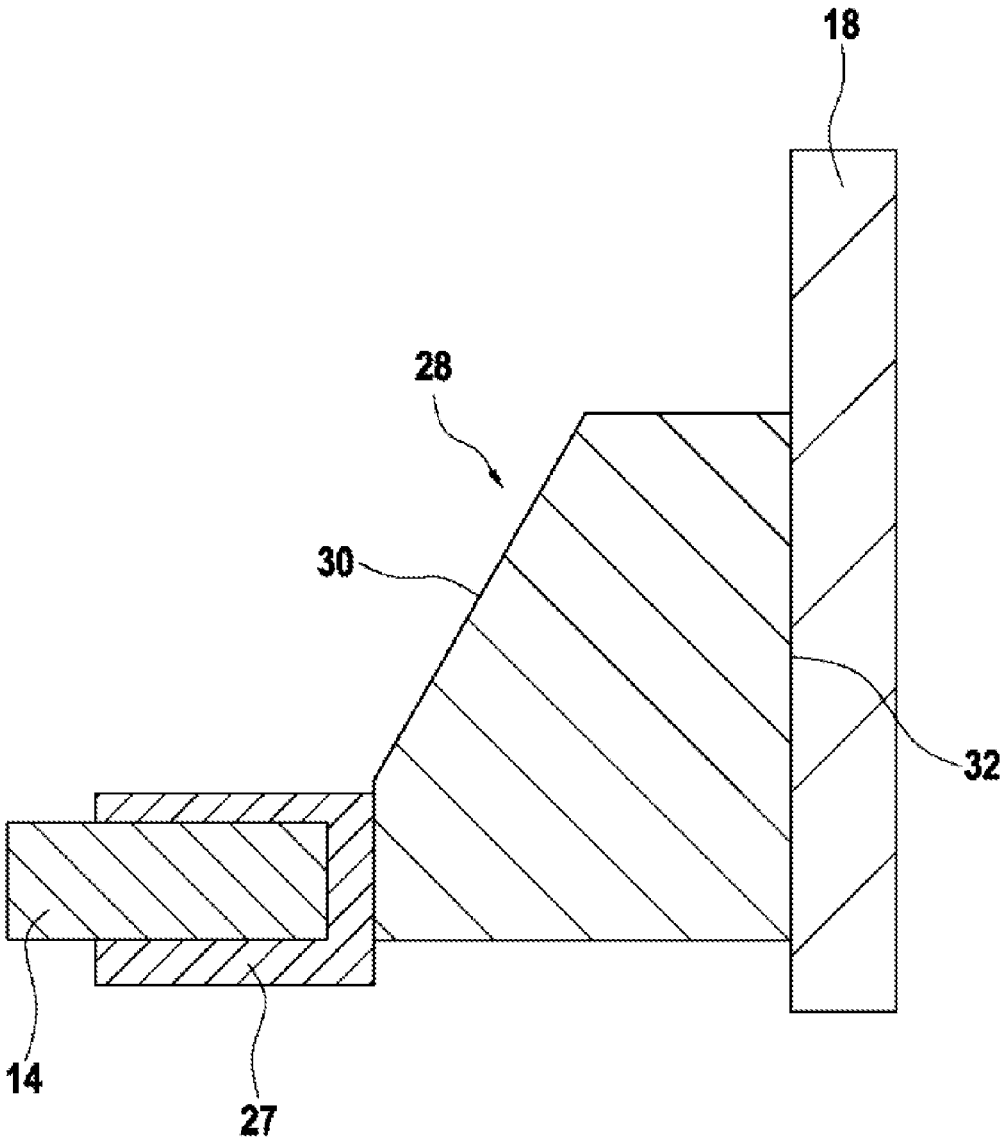
FIG. 7 a section through a corner piece with adjacent lower base plate and side wall of the ram of FIG. 1, in enlarged representation.

The corner pieces 28 are connected to the upper base plate 12 by, respectively, a pneumatic cylinder 34 articulately attached to the upper base plate 12 and to the respective corner piece 28. The fact that the corner pieces are guided between the lower base plate and the side walls obviates the need for any further guidance of the cylinders. In a first end position of the pneumatic cylinders 34, the corner cutouts 26 in the lower base plate 14 bear against the end faces 31 of the corner pieces 28. In this position, which can be seen, for instance, in FIG. 4, those bearing surfaces 32 of the corner pieces 28 which do not engage in the corner cutouts 26 and which run in the principal shaping direction z bear squarely against the side walls 18, i.e. the side walls 18 stand parallel to the principal shaping direction z. When the pneumatic cylinders 34 are actuated from the first end position into a second end position, the sloping faces 30 slide along the corner cutouts 26 in the lower base plate 14. Upon this displacement of the corner pieces 28 in the principal shaping direction z and, at the same time, in the direction of the center of the lower base plate 14, the side walls 18 which bear frictionally against the bearing surfaces 32 of the corner pieces 28 pivot inwards under the tensile force of the spring elements 22, 24 and with diminution of the base area delimited by the free end edges 19, i.e. pivot closer together in pairs. The distance e between the free end edges 19 of the mutually facing side walls 18 is in this position diminished. This position is represented in FIG. 5.

Figure 2:
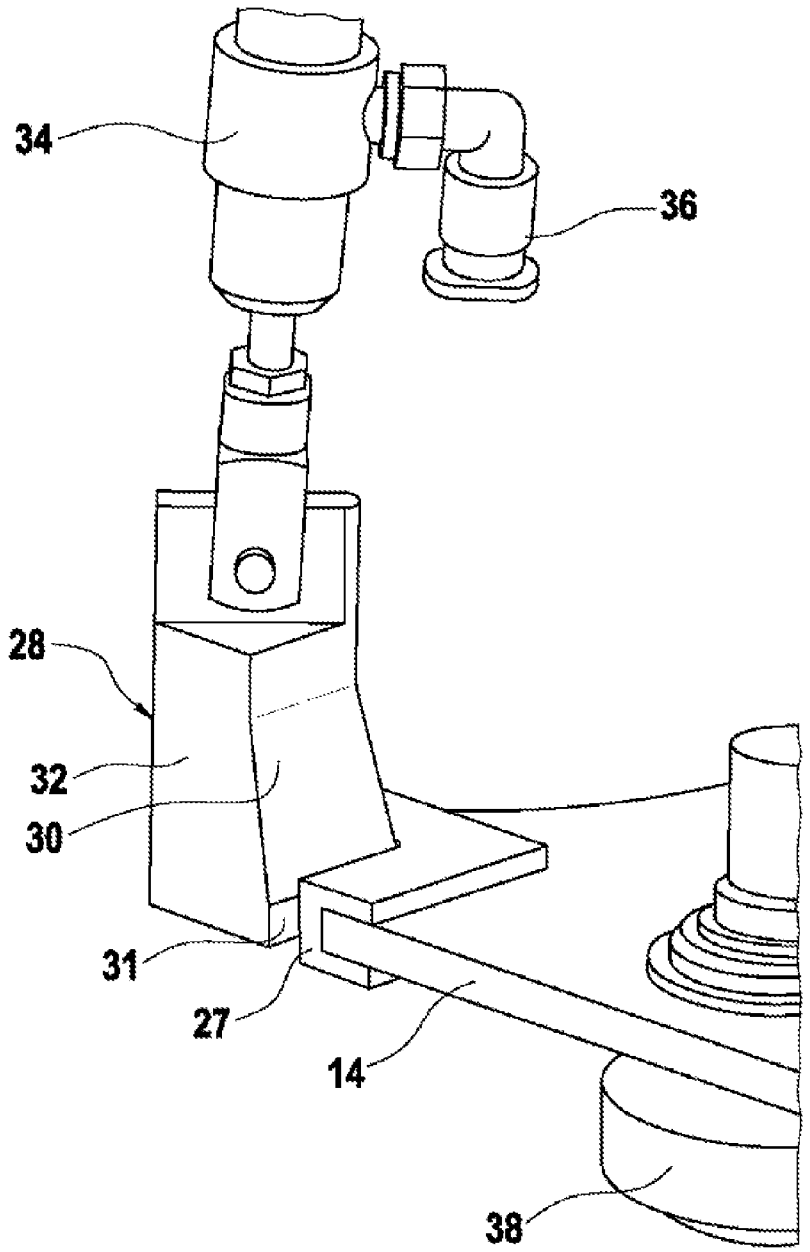
FIG. 2 an enlarged detail of the ram of FIG. 1.

In the embodiment shown in FIG. 2, the corner cutouts 26 are provided in the corners of the lower base plate 14 with a mountable profile piece 27 made of a low-friction plastics material. The corner pieces 28 can likewise be coated with a low-friction plastic or consist of a low-friction plastic. In FIG. 2 there is also a connecting part 36 disposed on one of the pneumatic cylinders 34, for connecting the pneumatic cylinder 34 by a pneumatic line to a compressed air reservoir (not represented in the drawing). A suction element 38, which is disposed on the outer side of the lower base plate 14 and is connectable to a vacuum source, can likewise be seen.

The ram 10 is usually fastened by a mounting flange 40 to a beam (not represented in the drawing).

Figure 3:
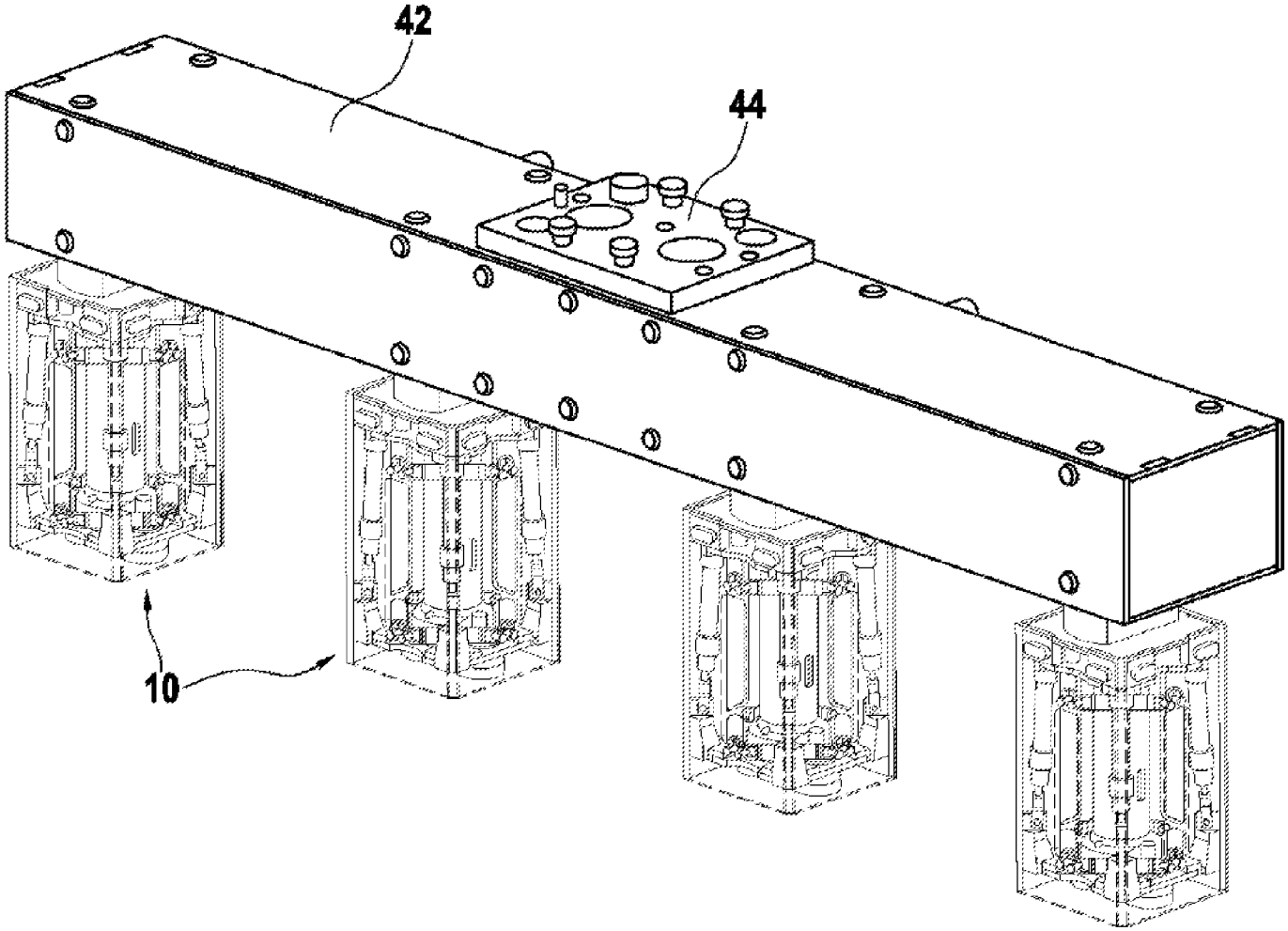
FIG. 3 a perspective view of an arrangement comprising four rams for the simultaneous shaping of four cardboard flat blanks.

In the embodiment shown in FIG. 3, four rams 10 are mounted on a crossbeam 42. The crossbeam 42 is fastened by a mounting plate 44 to a beam (not represented in the drawing).

Figure 8:
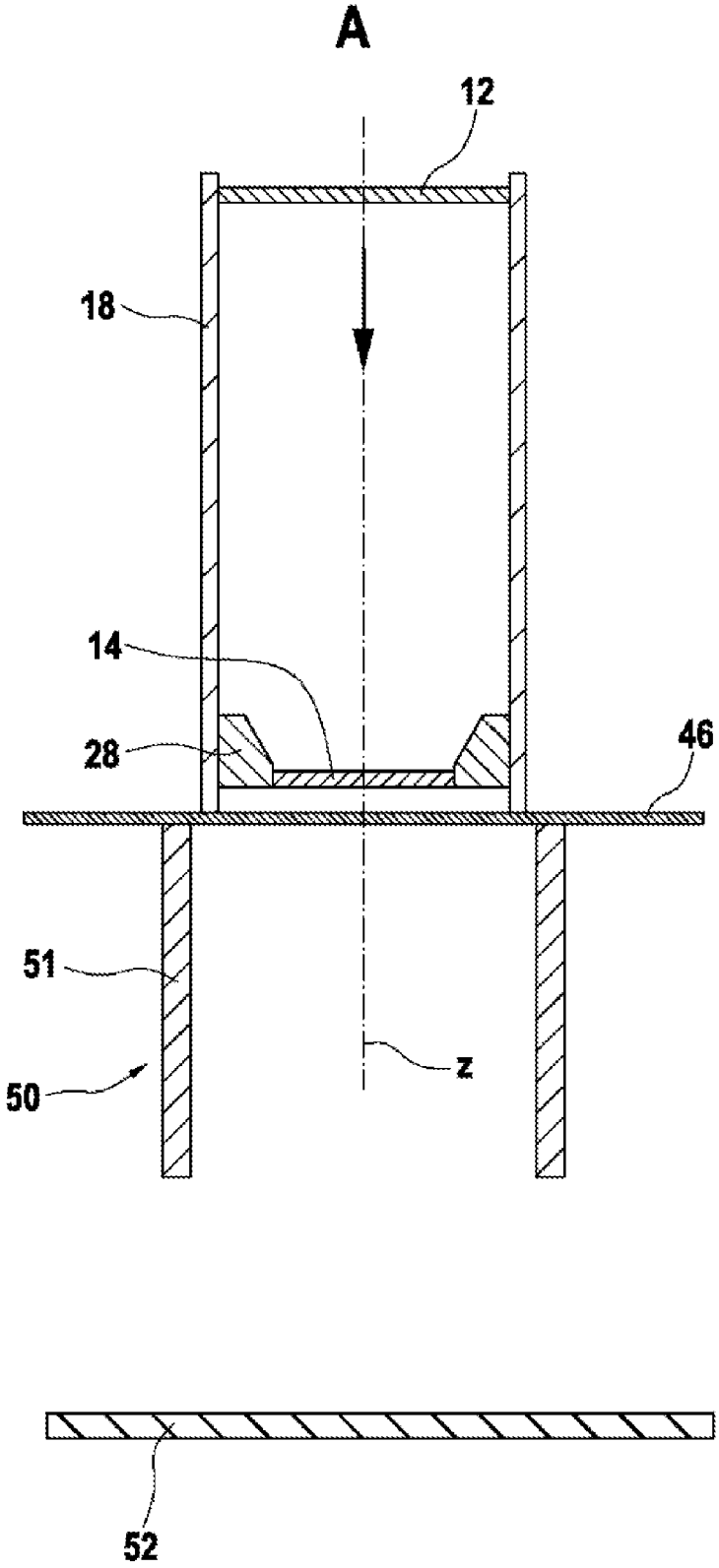
FIG. 8 the process sequence in the shaping of a container from a cardboard flat blank by the use of an inventive device.
Figure 8:
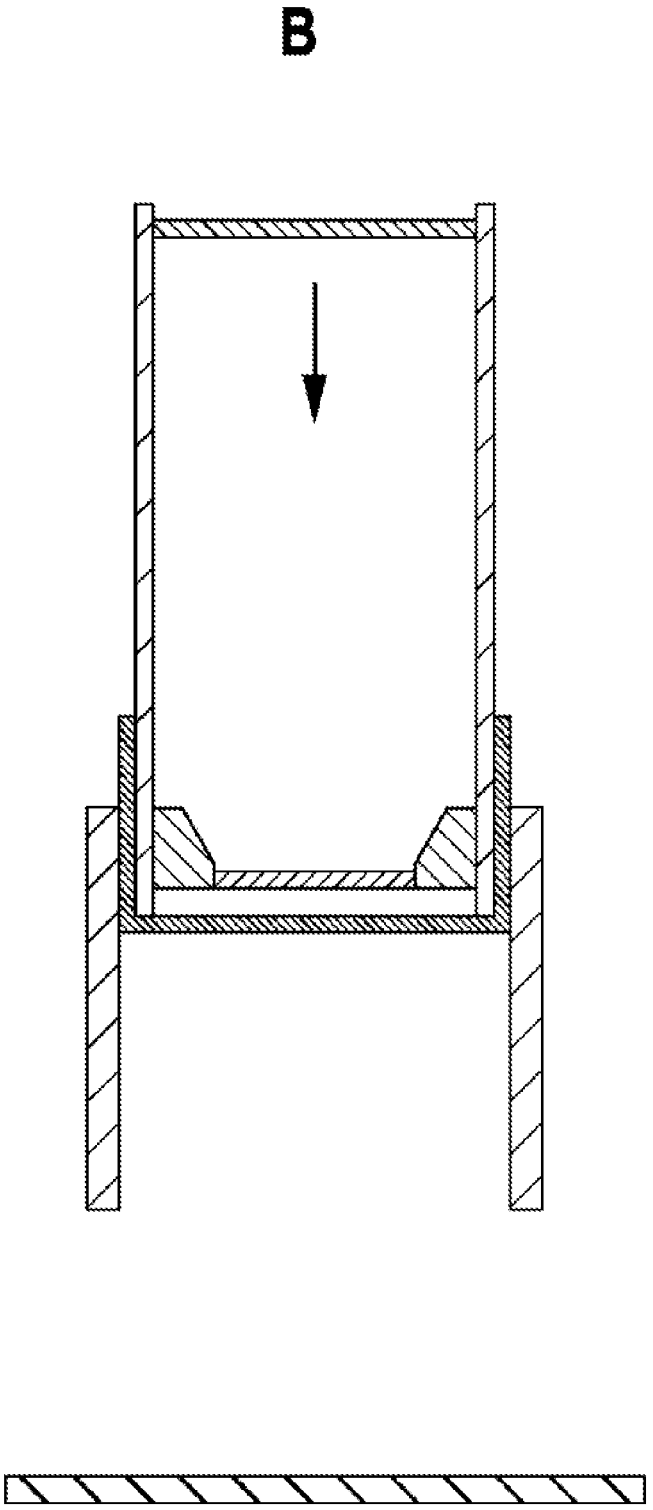
Figure 8:
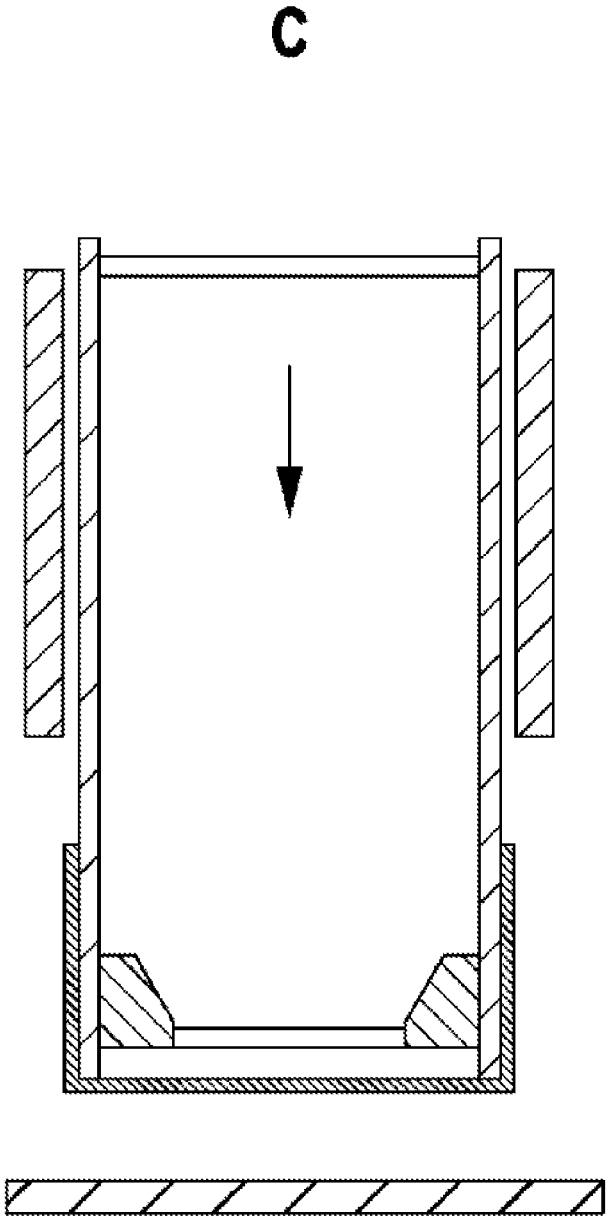
Figure 8:
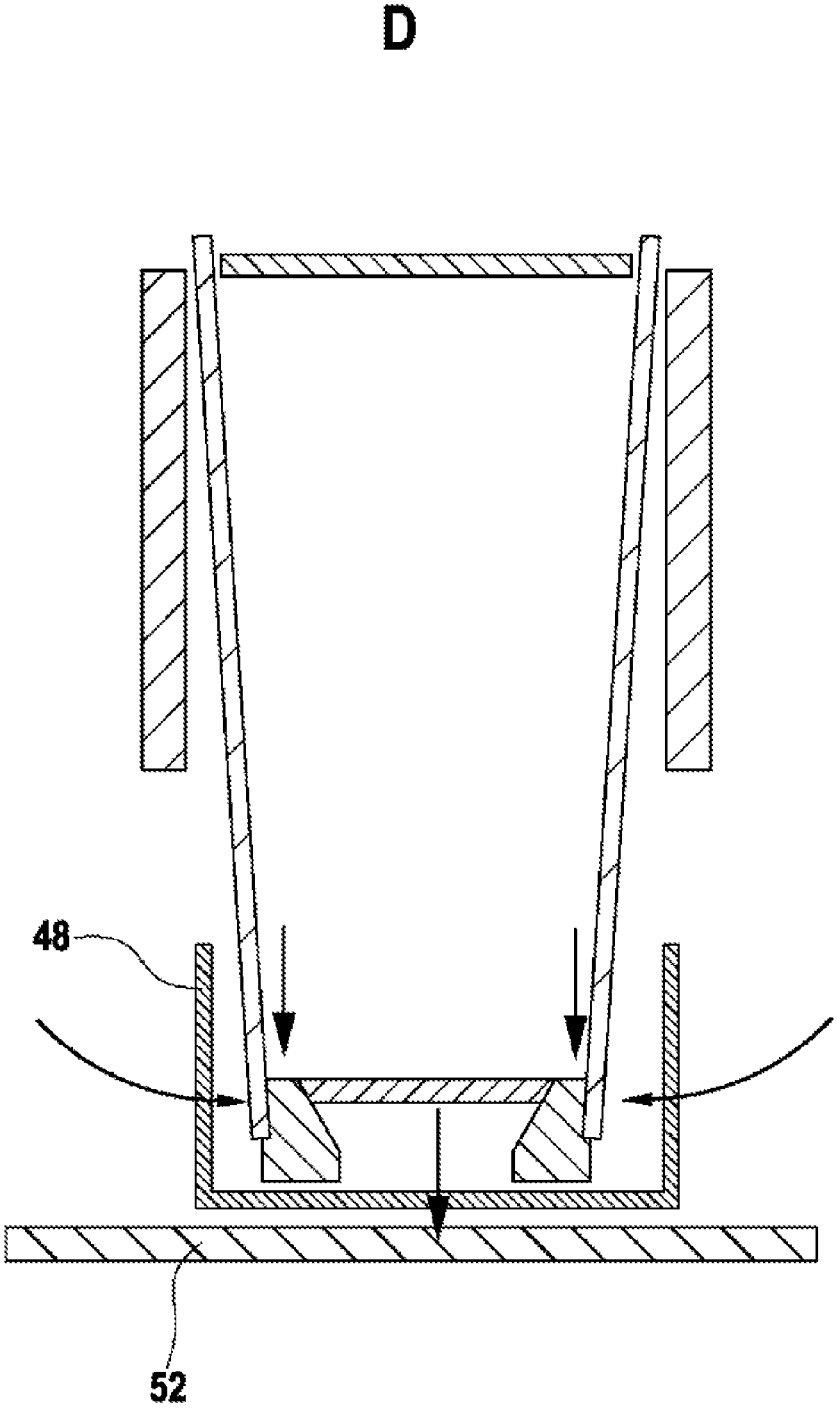
Figure 8:
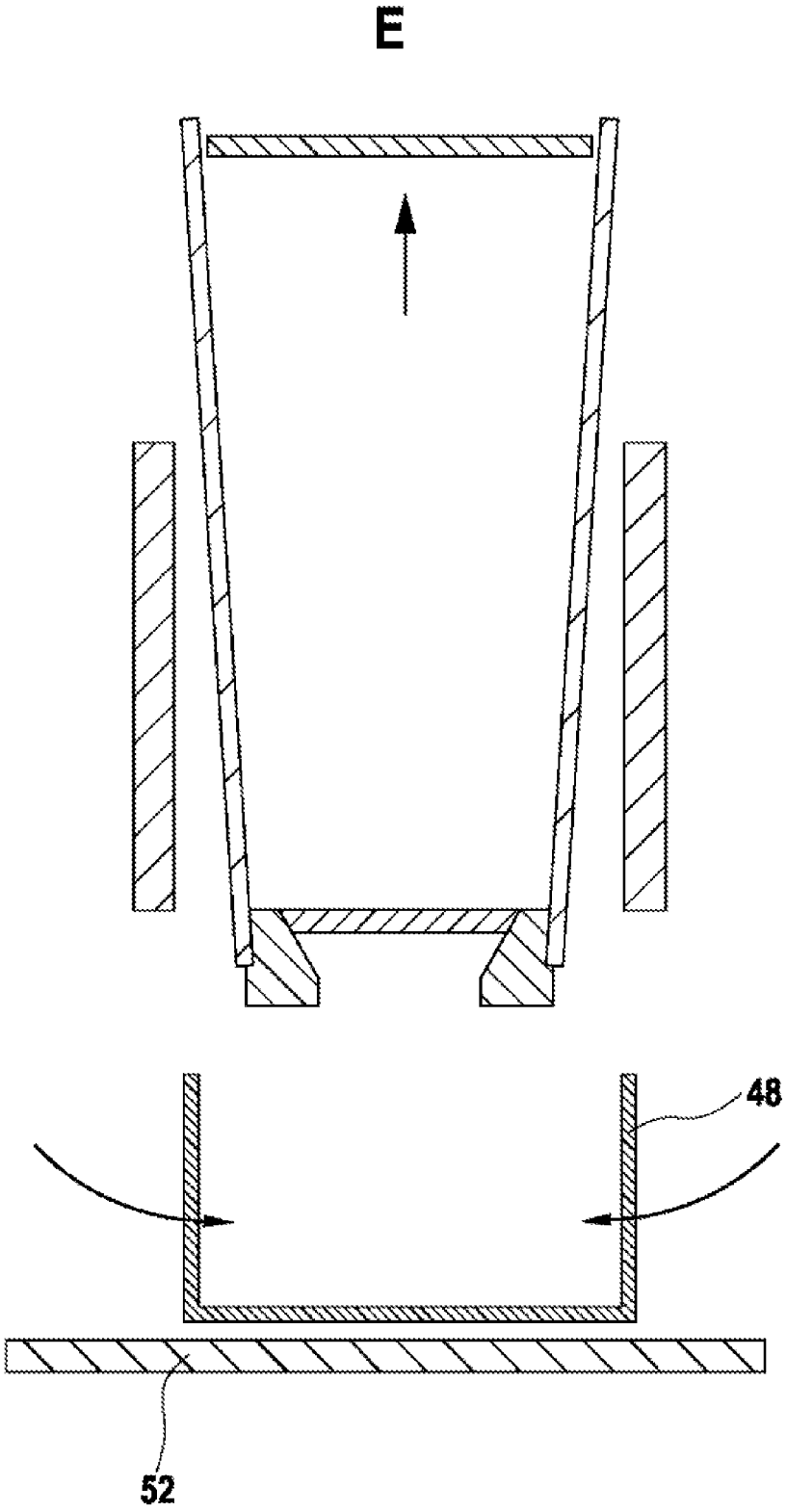

FIG. 8 shows the basic method steps involved in the erection of a flat cardboard blank 46 into a container 48 in five steps:

A A flat cardboard blank 46 is placed onto the upper rim of a tool 50 present in the form of a pipe piece of rectangular cross section and having four shaping walls 51 standing parallel to the principal shaping direction z. The ram 10, having side walls 18 standing parallel to the principal shaping direction z and parallel to the shaping walls 51 of the tool 50, is mounted onto the cardboard flat blank 46.

B The ram 10 is moved into the tool 50 and the flat cardboard blank 46 forced between the side walls 18 of the ram 10 and the shaping walls 51 of the shaping tool 50 is erected into a container 48 with lateral shaping walls 51 standing parallel to the principal shaping direction z. The shape of the erected container is maintained by hardening of previously applied hot glue, or by tuck-in flaps.

C The ram 10 is ejected with the container 48 from the shaping tool 50.

D The corner pieces 28 are pushed downwards. As a result, the side walls 18 pivot, with diminution of the base area of the ram 10, inwards away from the side walls of the shaped container 48. At the same time, the container 48 is pushed away from the ram 10 onto a conveyor belt 52 by the corner pieces 28, which run beyond the end edges 19 of the side walls 18 of the ram 10.

E The ram 10 runs back with inwardly pivoted side walls 18 through the shaping tool 50 into its starting position, wherein also the corner pieces 28 revert to the starting position and the side walls 18 pivot back into the vertical setting parallel to the shaping faces 51 of the shaping tool 50.

Figure 9:
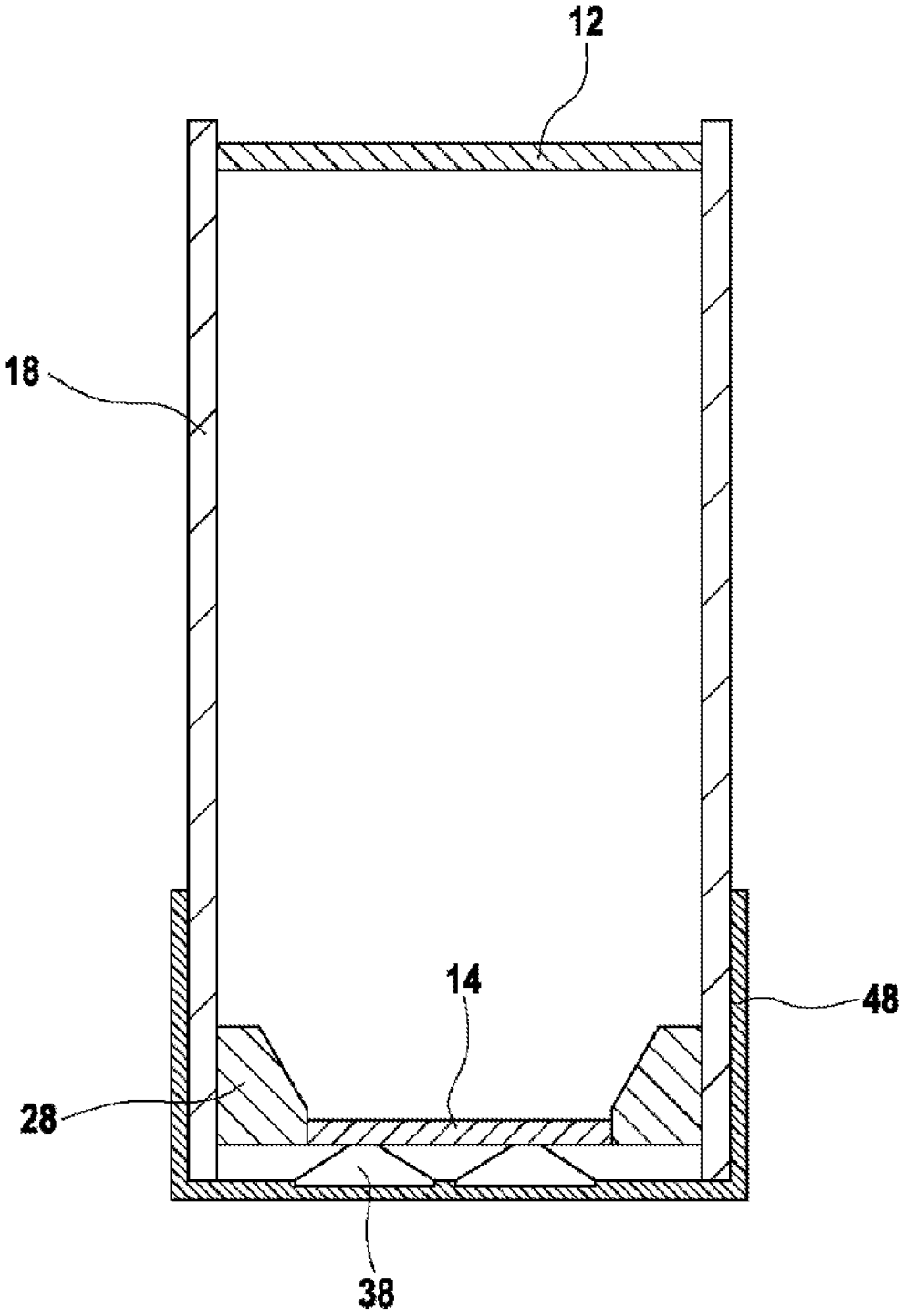
FIG. 9 a variant of the inventive ram.

FIG. 9 shows the ram variant represented also in FIGS. 1 to 3, with suction elements 38 protruding from the bottom side of the lower base plate 14. This ram variant is sensible, above all, if the containers 48, after their erection, are intended to remain on the ram and be transferred by means of the ram to a following station. With the suction elements 38 connected to a vacuum source, it is ensured that the container 48, after its erection, cannot inadvertently come loose from the ram 10 during transport.

What is claimed is:

1. A device for shaping a cardboard flat blank (46) into a container (48), comprising a shaping tool (50) and a ram (10) which is movable in a principal shaping direction (z) into the shaping tool (50) so as to erect the flat blank (46) via the shaping tool (50), wherein a base area of the ram (10) is adjustable in at least one shape-shaping direction (x, y) lying transversely to the principal shaping direction (z), characterized in that at least two side walls (18) pivotable about, respectively, a pivot axis (s) lying transversely to the principal shaping direction (z) are articulately attached to the ram (10), whereby a base area delimited by free end edges (19) of the side walls (18) is adjustable, the side walls (18) bearing in a frictionally sliding manner by means of pretensioned spring elements (22, 24), for the execution of a pivot motion, against wedge elements (28) which are displaceable in the principal shaping direction (z), wherein the ram (10) has a lower base plate (14) and the wedge elements (28) are disposed between the lower base plate (14) and the side walls (18), wherein the wedge elements (28) bear against the side walls (18).

2. The device as claimed in claim 1, characterized in that the wedge elements (28) are configured as corner pieces with sloping faces (30) and bear slidingly against profile pieces (27) in corner cutouts (26) of the lower base plate (14).

3. The device as claimed in claim 1, characterized in that the wedge elements (28) are displaceable by means of pneumatic cylinders (34).

4. The device as claimed in claim 1, characterized in that the side walls (18) are articulately attached to an upper base plate (12).

5. The device as claimed in claim 1, characterized in that side walls (18) which face one another in pairs are disposed on the ram (10) and the base area delimited by the end edges (19) of the side walls (18) has the shape of a rectangle.

6. The device as claimed in claim 1, characterized in that the ram (10) has on a free end at least one suction element (38).

7. The device as claimed in claim 1, characterized in that the device comprises a multiplicity of rams (10) with associated shaping tools (50) for simultaneously shaping a plurality of cardboard flat blanks (46) into containers (48).

8. The device as claimed in claim 1, wherein the wedge elements (28) are disposed between the lower base plate (14) and the side walls (18) along the at least one shape-shaping direction (x,y).

9. A device for shaping a cardboard flat blank (46) into a container (48), comprising a shaping tool (50) and a ram (10) which is movable in a principal shaping direction (z) into the shaping tool (50) so as to erect the flat blank (46) via the shaping tool (50), wherein a base area of the ram (10) is adjustable in at least one shape-shaping direction (x, y) lying transversely to the principal shaping direction (z), characterized in that at least two side walls (18) pivotable about, respectively, a pivot axis (s) lying transversely to the principal shaping direction (z) are articulately attached to the ram (10), whereby a base area delimited by free end edges (19) of the side walls (18) is adjustable, the side walls (18) bearing in a frictionally sliding manner by means of pretensioned spring elements (22, 24), for the execution of a pivot motion, against wedge elements (28) which are displaceable in the principal shaping direction (z), wherein the wedge elements (28) are displaceable by means of pneumatic cylinders (34).

10. The device as claimed in claim 9, characterized in that the wedge elements (28) are configured as corner pieces with sloping faces (30) and bear slidingly against profile pieces (27) in corner cutouts (26) of the lower base plate (14).

11. The device as claimed in claim 9, characterized in that the side walls (18) are articulately attached to an upper base plate (12).

12. The device as claimed in claim 9, characterized in that side walls (18) which face one another in pairs are disposed on the ram (10) and the base area delimited by the end edges (19) of the side walls (18) has the shape of a rectangle.

13. The device as claimed in claim 9, characterized in that the ram (10) has on a free end at least one suction element (38).

14. The device as claimed in claim 9, characterized in that the device comprises a multiplicity of rams (10) with associated shaping tools (50) for simultaneously shaping a plurality of cardboard flat blanks (46) into containers (48).

* * * * *